US012140043B1

(12) United States Patent
Herbert et al.

(10) Patent No.: US 12,140,043 B1
(45) Date of Patent: Nov. 12, 2024

(54) BLADE FOR A TURBINE, ROTOR ASSEMBLY FOR A TURBINE, AND TURBINE

(71) Applicant: DOOSAN ENERBILITY CO., LTD., Changwon (KR)

(72) Inventors: Brandl Herbert, Baden (CH); Krueckels Joerg, Baden (CH); Rathmann Ulrich, Baden (CH); Hofmann Willy, Baden (CH)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/397,204

(22) Filed: Dec. 27, 2023

(30) Foreign Application Priority Data

Jul. 19, 2023 (EP) ..... 23186279

(51) Int. Cl.
*F01D 5/20* (2006.01)
*F01D 5/14* (2006.01)
*F01D 5/18* (2006.01)

(52) U.S. Cl.
CPC ..... *F01D 5/147* (2013.01); *F01D 5/187* (2013.01); *F01D 5/20* (2013.01)

(58) Field of Classification Search
CPC . F01D 5/147; F01D 5/20; F01D 5/187; F01D 4/148
See application file for complete search history.

(56) References Cited

U.S. PATENT DOCUMENTS 3,635,585 A 1/1972 Metzler, Jr.
6,039,531 A 3/2000 Suenaga
8,398,370 B1 * 3/2013 Liang ..... F01D 5/187 416/97 R
2002/0197159 A1 12/2002 Roeloffs
2008/0044289 A1 2/2008 Klasing
2009/0068021 A1 * 3/2009 Liang ..... F01D 5/187 416/97 R
2017/0226868 A1 8/2017 Martinello
2017/0226871 A1 8/2017 Auzillon

OTHER PUBLICATIONS

Xue S, Ng WF. Turbine Blade Tip External Cooling Technologies. Aerospace. 2018; 5(3):90. https://doi.org/10.3390/aerospace5030090 (https://www.mdpi.com/2226-4310/5/3/90).
EP EESR Dated Dec. 10, 2023.

* cited by examiner

*Primary Examiner* — Deming Wan
(74) *Attorney, Agent, or Firm* — Harvest IP Law, LLP

(57) ABSTRACT

A blade for a turbine includes an airfoil extending between a platform end and a tip and between a leading edge and a trailing edge. A squealer tip wall protrudes from a tip surface of the tip and defines a tip cavity. At least one separator wall protrudes from the tip surface and divides the tip cavity into at least a first tip cavity lying on a first side of the separator wall facing the pressure side, and a second tip cavity lying on a second side of the separator wall facing the suction side. A first exit opening is formed in the squealer tip wall in the area of the trailing edge, wherein the first exit opening defines a fluid passage between the first tip cavity and the pressure side. A second exit opening is formed in the squealer tip wall in the area of the trailing edge, wherein the second exit opening defines a fluid passage between the second tip cavity and the suction side.

20 Claims, 7 Drawing Sheets

BLADE FOR A TURBINE, ROTOR ASSEMBLY FOR A TURBINE, AND TURBINE

CROSS-REFERENCE TO RELATED APPLICATION(S)

This application claims priority to European Patent Application No(s). 23186279.8, filed on Jul. 19, 2023, the disclosure(s) of which is(are) incorporated herein by reference in its (their) entirety.

BACKGROUND OF THE INVENTION

Field of the Invention

The present disclosure relates to a blade for a turbine, to a rotor assembly for a turbine, and to a turbine.

Description of the Related Art

Blades of a turbine, e.g., of a steam or a gas turbine, typically, are mounted to a rotor disk rotating at high speed. A tip of the blade usually faces a turbine casing, wherein a small gap is present between the turbine casing and the blade. Due to the high velocity at which the blades rotate and due to the pressure difference between a suction side and a pressure side of the blade, a gas flow through the gap may occur which is referred to as over tip leakage. Over tip leakage flow forms a tip leakage vortex which causes aerodynamic losses decreasing the turbine's efficiency.

To reduce over tip leakage, various forms of squealer tips have been proposed that include a wall protruding from the tip of an airfoil of the blade, wherein the wall defines a tip cavity. Song Xue et al. in "Turbine Blade Tip External Cooling Technologies", (Aerospace 2018, 5, 90) available under URL https://www.mdpi.com/2226-4310/5/3/90 discuss various aspects related to and measures reducing over tip leakage.

Documents U.S. Pat. No. 6,039,531 A and US 2002/0 197 159 A1 disclose a turbine blade comprising an airfoil that has a squealer tip extending along an entire circumference of the tip of the airfoil.

U.S. Pat. No. 3,635,585 A proposes a blade having a walled cavity at its tip, wherein cooling passages terminate at the bottom of the cavity. A portion of the wall is cut away on the low-pressure side of the blade adjacent its trailing edge such that the passages in the blade do not discharge into the main turbine gas stream but rather into a relatively constant pressure area within the cavity.

US 2008/0 044 289 A1 discloses a turbine blade comprising an airfoil which, at its tip, is provided with a wall protruding from the tip and extending along the entire circumference of the tip. The wall is formed by a pressure side rib and a suction side rib. A baffle protrudes from the tip and extends axially from a forward portion of the suction side rib near the leading edge to an aft portion of the same rib forward of the trailing edge. The baffle divides the tip of the airfoil into two cavities. A converging exit ramp is introduced at the aft ends of both cavities to provide a smooth transition for gas leaking into the respective cavity and discharging from the cavities.

SUMMARY OF THE INVENTION

It is one of the objects of the present disclosure to provide improved solutions for reducing an over tip leakage on a blade of a turbine.

To this end, the present disclosure provides a blade for a gas turbine, a rotor assembly and a turbine including the blade.

According to a first aspect of the present disclosure, a blade for a turbine comprises an airfoil extending between a platform end and a tip in a radial direction and extending between a leading edge and a trailing edge in an axial direction, wherein the tip comprises a tip surface. A pressure side surface and a suction side surface meet at the leading edge and at the trailing edge, wherein the pressure side surface defines a pressure side of the airfoil, and the suction side surface defines a suction side of the airfoil. The pressure side surface, for example, may comprise a concave curvature. The suction side surface, for example, may comprise a convex curvature. The tip surface defines a radial end of the airfoil and may, optionally, be a planar or substantially planar surface or comprise multiple planar or substantially planar surface areas.

The blade further includes a squealer tip wall protruding from the tip surface and defining a tip cavity. The squealer tip wall protrudes, at least partially, in the radial direction from the tip surface. For example, an outer surface of the squealer tip wall may extend continuously with the suction side surface and the pressure side surface, respectively. The squealer tip wall at least partially surrounds the tip surface or, in other words, extends along at least a part of the periphery of the radial end of the tip on both, the suction side and the pressure side. Thereby, the squealer tip defines a tip cavity having a bottom formed by the tip surface and which circumference is limited by the squealer tip wall. Hence, the tip cavity is open with regard to the radial direction. The tip cavity forms a volume into which working fluid streaming along the pressure side surface and the suction side surface of the airfoil may leak.

According to the present disclosure, the blade further comprises at least one separator wall protruding from the tip surface. The separator wall protrudes, at least partially, in the radial direction from the tip surface. The separator wall divides the tip cavity into at least a first tip cavity lying on a first side of the separator wall facing the pressure side, and a second tip cavity lying on a second side of the separator wall facing the suction side. Thus, the separator wall may, at least partially, extend along the axial direction. The separator wall separates the first tip cavity and the second tip cavity. Thereby, the tip cavity is divided into two volumes or sub-cavities, one of which being adjacent to the pressure side of the airfoil, the other one being adjacent to the suction side. Hence, working fluid leaking over the tip from the pressure side flows into the first tip cavity and, from there, may also flow into the second tip cavity. Further, it is not excluded that working fluid leaks over the tip from the suction side, e.g., in a region close to the leading edge, and flows into the second tip cavity.

The blade further includes a first exit opening formed in the squealer tip wall in the area of the trailing edge and a second exit opening formed in the squealer tip wall in the area of the trailing edge. The first exit opening defines a fluid passage between the first tip cavity and the pressure side. The second exit opening defines a fluid passage between the second tip cavity and the suction side. The exit openings allow fluid that leaks into the respective cavity to be discharged again from the respective cavity into the flow of working fluid in a region close to the trailing edge. In particular, the fluid being present in the first tip cavity, which lies on the side of the separator wall facing the pressure side, is discharged on the pressure side, and the fluid present in the second tip cavity, which lies on the side of the separator wall facing the suction side, is discharged on the suction side. Since the exit openings are positioned each in the region of the trailing edge, the fluid is discharged into an area of relatively low pressure which helps in preventing the working fluid to leak from the pressure side to the suction side of the airfoil. The exit openings each are formed in the squealer tip wall. For example, the squealer tip wall may be interrupted or cut or drilled through to form the respective opening therein.

According to a second aspect of the present disclosure, a rotor assembly comprises a rotor disk and a plurality of the blades according to the first aspect of the present disclosure, wherein the blades are coupled to the rotor disk.

According to a third aspect of the present disclosure, a turbine includes a blade according to the first aspect of the present disclosure. For example, the turbine may comprise a rotor assembly according to the second aspect of the present disclosure.

It is one of the ideas of the present disclosure to provide a squealer tip wall and separator wall on a tip of an airfoil to define a first, pressure side cavity and a second, suction side cavity on the tip, and to form exit or discharge openings in the squealer tip wall on the suction side and on the pressure side, close to the trailing edge through which fluid can be discharged from the respective cavity to the respective suction or pressure side.

The separator wall forms an additional barrier for working fluid leaking from the pressure side over the tip of the airfoil and redirects the leaked fluid towards the trailing edge as it extends along the axial surface. Thereby, the separator wall helps to prevent or reduce over tip leakage flow. The fluid leaking into the first and second cavities is again discharged into an area of relatively low pressure close to the trailing edge which further helps in preventing the working fluid to leak from the pressure side to the suction side of the airfoil. Additionally, by providing the exit openings within the squealer tip wall, the fluid from the respective cavity can be discharged directly into the respective flow on the pressure side and the suction side. Thereby, aerodynamic losses in the tip region can be reduced.

A further advantage of the separator wall is that it places additional mass on the tip of the airfoil without being directly exposed to the main flow of working fluid. Thereby, the mass of the separator wall may be used and adjusted to improve vibrational behavior of the blade, e.g., to tune a frequency of the vibrations of the blade. Moreover, the separator wall acts as a stiffener.

Further embodiments of the present disclosure are subject of the dependent claims and the following description, referring to the drawings.

According to some embodiments, the separator wall may extend from the region of the leading edge to the trailing edge of the airfoil. For example, the separator wall may be connected to the squealer tip wall in the region of the leading edge and, from there, extend towards the trailing edge. Optionally, the separator wall may end at the trailing edge. Thereby, the separator wall provides a barrier or obstacle for the leaked fluid between the pressure side and the suction side all the way to the trailing edge. This helps to further reduce the over tip leakage. In particular, as the separator wall extends all the way down to the trailing edge, the leaked fluid is efficiently redirected towards the trailing edge. Since the obstacle formed by the separator wall extends to the trailing edge, the flow of fluid leaking over the squealer tip wall at the suction side can be further reduced, whereby an amount of fluid provided to an over tip leakage vortex is reduced. As a result, aerodynamic losses caused by the over tip leakage are further reduced.

According to some embodiments, the separator wall may extend curved in an arc shape. For example, the separator wall may comprise a concave curved first surface facing the pressure side and a convex curved second surface facing the suction side. The arc shaped, curved course of the separator wall helps in defining the first and second cavities with a shape that narrows smoothly towards the trailing edge. In particular, the separator wall may extend curved such that a width of the respective first or second cavity with respect to a circumferential direction perpendicular to the radial direction and the axial direction, narrows towards the trailing edge. Thereby, leaked fluid flowing in the respective cavity is smoothly guided towards the trailing edge which reduces pressure loss and helps to further improve aerodynamic properties of the blade.

According to some embodiments, a wall thickness of the separator wall may lie in a range between $1/4$ to $1/32$, in particular between $1/16$ and $1/32$, of a profile thickness of the airfoil. The profile thickness may be defined as a diameter of an incircle touching the suction side surface and the pressure side surface at an axial position of the blade where the diameter of the incircle is maximum. The profile thickness is measured at the tip of the airfoil. This range provides a good compromise for manufacturing and aerodynamic benefit. Optionally, the separator wall, over its length, has a substantially constant wall thickness.

According to some embodiments, the squealer tip wall may comprise a first wall portion that extends in a first peripheral area of the tip surface facing the pressure side, and a second wall portion of the squealer tip wall that extends in a second peripheral area of the tip surface facing the suction side, wherein the first exit opening is formed in the first side wall portion, and wherein the second exit opening is formed in the second side wall portion.

According to some embodiments, the separator wall may be connected to the second wall portion of the squealer tip wall and extend to the trailing edge of the airfoil. Connecting the separator wall to the second wall portion may help in forming the first cavity with a somewhat greater volume than the second cavity which is advantageous because leakage flow from the pressure side tends be greater than leakage flow from the suction side. Optionally, the separator wall may end at the trailing edge. Thereby, the separator wall separates the flow of leaked fluid on the first side, i.e., the pressure side, of the separator wall and the flow of leaked fluid on the second side, i.e., the suction side, of the separator wall all the way to the trailing edge. This helps to further reduce the over tip leakage and reduces aerodynamic losses caused by the over tip leakage.

According to some embodiments, the first wall portion of the squealer tip wall may end distanced to the trailing edge, and the first exit opening may be formed as a gap between an end region of the first wall portion facing the trailing edge and an end region of the separator wall facing the trailing edge. For example, the first wall portion of the squealer tip wall and the separator wall may approach each other towards the trailing edge so that a channel is defined therebetween, wherein the separator wall extends further towards the trailing edge than the first wall portion of the squealer tip wall, and the first exit opening is formed at the end of the channel defined by an end of the first wall portion of the squealer tip wall. Thereby, pressure losses of the leaked fluid being discharged through the first exit opening can be further reduced.

According to some embodiments, a groove may be formed in a transition between the tip surface and the pressure side surface adjacent to the trailing edge, and wherein the first exit opening opens into the groove. Since the trailing edge, typically, is a highly filigree structure, the groove eases forming the first exit opening. Optionally, cooling holes for discharging cooling fluid may be formed in the groove. Thereby, the leaked fluid can be discharged from the first cavity without compromising cooling of the region of the trailing edge.

According to some embodiments, the second wall portion of the squealer tip wall may end distanced to the trailing edge, and the second exit opening may be formed as a gap between an end region of the second wall portion facing the trailing edge and an end region of the separator wall facing the trailing edge. For example, the second wall portion of the squealer tip wall and the separator wall may approach each other towards the trailing edge so that a channel is defined therebetween, wherein the separator wall extends further towards the trailing edge than the second wall portion of the squealer tip wall, and the second exit opening is formed at the end of the channel defined by an end of the second wall portion of the squealer tip wall. Thereby, pressure losses of the leaked fluid being discharged through the first exit opening can be further reduced. Optionally, in the end region of the second wall portion, a wall thickness of the second wall portion may decrease towards the trailing edge. Thereby, the channel can be formed with a substantially constant width.

According to some embodiments, the separator wall may protrude further from the tip than the squealer tip wall. Thereby, the separator wall reduced the width of a gap between the blade and a turbine casing. Generally, over tip leakage can be further reduced thereby.

According to some embodiments, the airfoil, at the tip, may comprise a tip chord length, and a distance of the first exit opening to the trailing edge and/or a distance of the second exit opening to the trailing edge may lie in a range between 1/12 to 1/3, in particular between 1/9 and 1/4 of the tip chord length. The tip cord length may be a distance, measured parallel to a tangent line touching the airfoil from the pressure side, between the trailing edge and a point on the suction side surface having a greatest distance to the trailing edge. Since the pressure side surface comprises a generally concave curvature, the tangent line touches the pressure side surface close to the leading edge and close to the trailing edge. The distance of the first exit opening and/or the second exit opening to the trailing edge may be measured parallel to the tangent line.

According to some embodiments, the second exit opening may lie further distanced from the trailing edge than the first exit opening. On the one hand, this configuration eases manufacturing the first and second exit openings. On the other hand, aerodynamic losses in connection with over tip leakage can be further reduced by this configuration.

According to some embodiments, the first tip cavity may comprise a first depth measured in the radial direction from the tip surface in the first tip cavity to a radial end of the first wall portion, and the second tip cavity may comprise a second depth measured in the radial direction from the tip surface in the second tip cavity to a radial end of the second wall portion, the second depth may be different from the first depth, e.g., smaller or larger than the first depth. Further optionally, it may be provided that at least one of the first and second depths varies along the axial direction.

According to some embodiments, a plurality of cooling holes may be formed in the tip surface in the first tip cavity and/or in the second tip cavity. Thereby, efficient tip cooling is achieved. Further, the cooling fluid being discharged from the cooling holes can be more efficiently mixed with the flow of working fluid as it is, at least in part, discharged through the respective first or second discharge opening.

According to some embodiments, the second exit opening may positioned closer to the trailing edge of the respective blade than a throat defined between the suction side surface of the respective blade and a pressure side surface of a further blade positioned adjacent to the respective blade. The throat may be defined as a position on the suction side surface of the airfoil having shortest distance to the pressure side surface of the adjacent blade. Discharging the fluid from the second cavity on the suction side downstream of the throat further reduces pressure loss and thereby improves the aerodynamic properties of the blade.

According to some embodiments, turbine may be a gas turbine comprising a compressor configured to compress a working fluid, a combustor receiving compressed working fluid from the compressor and configured to burn a fuel to heat the working fluid, and a turbine part comprising at least one rotor assembly as described above, the turbine part being configured to expand the working fluid causing the rotor assembly to rotate. Hence, the rotor assembly may form part of the turbine. As a working fluid, the compressor may suck air from the environment, and the compressed air may be used for combustion of the fuel in the combustor or burner. As a fuel, liquid fuel, such as kerosene, diesel, ethanol, or similar may be used. Alternatively, gaseous fuel such as natural gas, fermentation gas, hydrogen, or similar can be used.

The features and advantages described herein with respect to various aspects of the present disclosure are also disclosed for the other aspects and vice versa.

With respect to directions and axes, in particular, with respect to directions and axes concerning the extension or expanse of physical structures, within the scope of the present disclosure, an extent of an axis, a direction, or a structure "along" another axis, direction, or structure includes that said axes, directions, or structures, in particular tangents which result at a particular site of the respective structure, enclose an angle which is smaller than 45 degrees, preferably smaller than 30 degrees and in particular preferable extend parallel to each other.

With respect to directions and axes, in particular with respect to directions and axes concerning the extension or expanse of physical structures, within the scope of the present disclosure, an extent of an axis, a direction, or a structure "crossways", "across", "cross", or "transversal" to another axis, direction, or structure includes in particular that said axes, directions, or structures, in particular tangents which result at a particular site of the respective structure, enclose an angle which is greater or equal than 45 degrees, preferably greater or equal than 60 degrees, and in particular preferable extend perpendicular to each other.

BRIEF DESCRIPTION OF THE DRAWINGS

For a more complete understanding of the present disclosure and advantages thereof, reference is now made to the following description taken in conjunction with the accompanying drawings. The present disclosure is explained in more detail below using exemplary embodiments, which are specified in the schematic figures of the drawings, in which.

In the figures, like reference signs denote like elements unless stated otherwise.

DETAILED DESCRIPTION OF EXEMPLARY EMBODIMENTS

Figure 1:
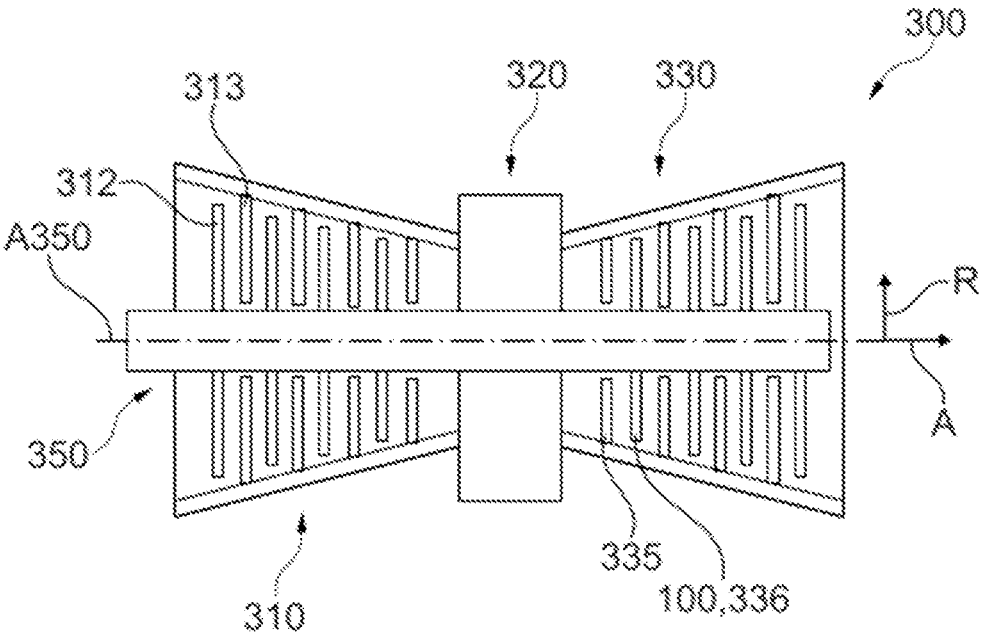
FIG. 1 schematically illustrates a cross-sectional view of a gas turbine according to an embodiment of the present disclosure.

FIG. 1 schematically shows a gas turbine 300. The gas turbine 300 includes a compressor 310, a burner or combustor 320, and a turbine 330. The turbine 330 and the compressor 310 may be mechanically integrated to form a rotor 350 which is rotatable about a common rotational axis A350.

The compressor 310 of the gas turbine 300 may draw air as a working fluid from the environment and compress the drawn air. The compressor 310 may be realized as centrifugal compressor or an axial compressor. FIG. 1 exemplarily shows a multistage axial compressor which is configured for high mass flows of air. The axial compressor may include multiple rotor disks, each carrying a plurality of blades. The rotor disks (not shown in FIG. 1) are coupled to each other in the axial direction so as to be rotatable together about the rotational axis A350. Compressor vanes 313 are arranged downstream of the blades 312 for each stage. The blades 312 compress the introduced air and deliver the compressed air to the compressor vanes 313 disposed adjacently downstream. The plurality of compressor vanes 313 guide the compressed air flowing from the upstream compressor blades 312 to a downstream stage compressor blades 312. The air is compressed gradually to a high pressure while passing through the stages of compressor blades 312 and vanes 313.

The compressed air is supplied to the combustor 320 for combustion of a fuel, such as natural gas, hydrogen, diesel, kerosene, ethanol or similar. Further, a part of the compressed air is supplied as a gaseous cooling fluid to high-temperature regions of the gas turbine 300 for cooling purposes. The burner or combustor 320, by use of the compressed air, burns fuel to heat the compressed air.

As schematically shown in FIG. 1, the turbine 330 includes a plurality of blade assemblies, each comprising a rotor disk to which a plurality of turbine blades 336 are coupled. The turbine 330 further includes a plurality of turbine vanes 335. Generally, the rotor disks are coupled to each other so as to be rotatable together about the rotational axis A350. For example, the rotor disks of the turbine and the rotor disks of the compressor may be fastened together by means of a central element such as a bolt to form the rotor 350. The turbine blades 336 are coupled to the respective rotor disk and extend radially therefrom. The turbine vanes 335 are positioned upstream of the blades 336 of the respective rotor disks 210. The turbine vanes 335 are fixed in a stator frame so that they do not rotate about the rotational axis and guide the flow of combustion gas coming from the burner 320 passing through the turbine blades 336. The combustion gas is expanded in the turbine 330 and gas applies a force to the turbine blades 336 which causes the rotor 350 to rotate about the rotational axis A350. The compressor 310 may be driven by a portion of the power output from the turbine 330. Although the present disclosure is further explained in the following under reference to a gas turbine, the present disclosure is not limited thereto. For example, the present disclosure may also be used in a steam turbine or in another type of turbomachinery.

Figure 2:
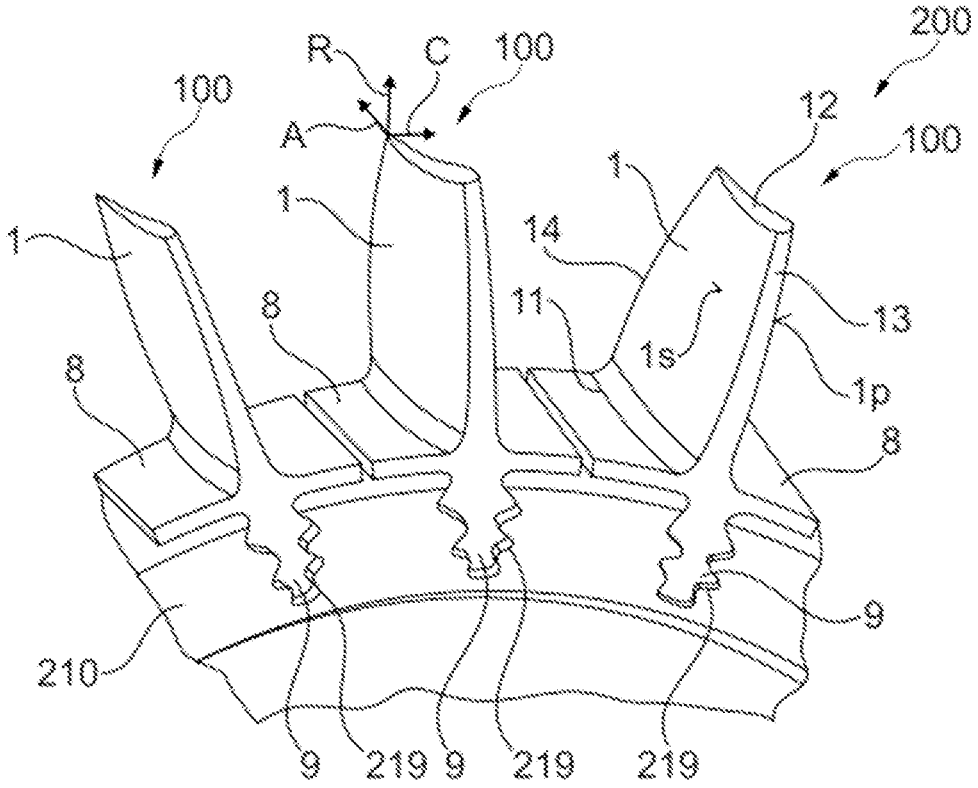
FIG. 2 shows a perspective, partial view of a rotor assembly according to an embodiment of the present disclosure.

FIG. 2 shows a rotor assembly 200 of the turbine 330. As explained above, the rotor assembly 200 includes a rotor disk 210 and a plurality of blades 100.

The rotor disk 210, generally, may have the form of a ring and, at its outer circumference, includes multiple coupling interfaces 219 for coupling the blades 100 to the disk 210. As exemplarily shown in FIG. 2, the coupling interfaces 219 may be formed by grooves. As an example, FIG. 2 shows grooves that have a cross-sectional shape like a firtree.

As shown in FIG. 2, the rotor assembly 200 includes multiple blades 100, e.g., blades 312 of the compressor 310 or blades 336 of the turbine 330. The blades 100 will be discussed in more detail below by reference to FIGS. 3 to 6.

Generally, as shown schematically in FIG. 2, each blade 100 includes an airfoil 1, a platform 8, and a root 9.

The airfoil 1 comprises a pressure side surface 1*p* and an opposite suction side surface 1*s*. The pressure side surface 1*p* defines a pressure side PS of the airfoil 1, and the suction side surface 1*s* defines a suction side SS of the airfoil 1. As only schematically shown in FIG. 2 and as better visible in FIGS. 3 and 4, the pressure side surface 1*p* may be curved concave, and the suction side surface 1*s* may be curved convex. Generally, the airfoil 1 extends with respect to an axial direction A between a leading edge 13 and a trailing edge 14. The pressure side surface 1*p* and the suction side surface 1*s* meet at the trailing edge and at the leading edge 13. With regard to a radial direction R, which is perpendicular to the axial direction A, the airfoil 1 extends between a platform end 11 and a tip 12 in the radial direction R. The axial direction A may be parallel to the rotational axis A350. In the axial direction A, the direction from the leading edge 13 toward the trailing edge 14 may be referred to the downstream direction while the opposite direction may be referred to as the upstream direction.

As schematically shown in FIG. 2, the platform 8 may be a substantially plate shaped structure having an expanse both in the axial direction A and the circumferential direction C. The circumferential direction C is perpendicular to the axial direction A and to the radial direction R. The platform 8 is coupled to the platform end 11 of the airfoil 1 and may protrude from the airfoil 1 in the circumferential direction C.

The root 9 is connected to the platform 8, in particular, to a lower surface of the platform 8 and protrudes from the lower surface of the platform 8 along the radial direction R. Hence, the airfoil 1 and the root 9, with respect to the radial direction R, extend at opposite sides of the platform 8. As exemplarily shown in FIG. 2, the root 9 may include a firtree shaped cross-section. Generally, the coupling interfaces 219 of the rotor disk 210 and the roots 9 of the blades 100 may have cross-sections that are complementary or corresponding to each other.

Figure 3:
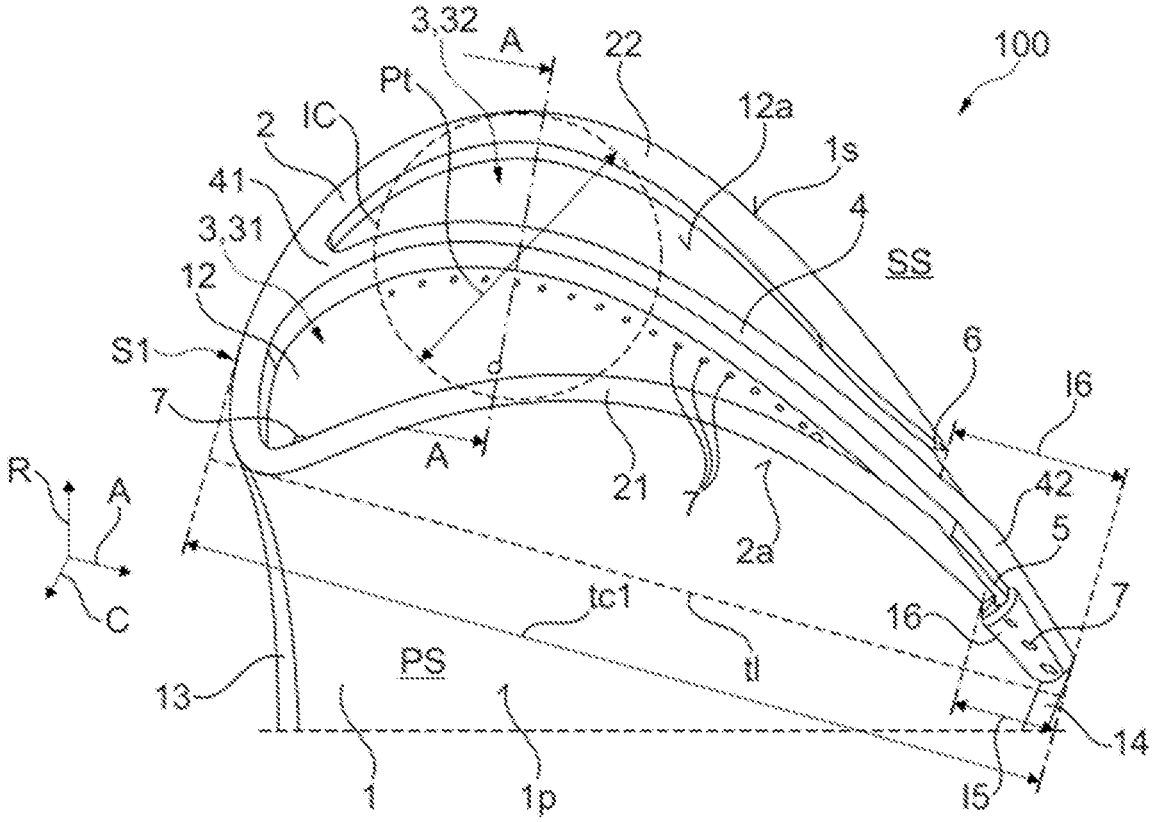
FIG. 3 illustrates a partial perspective view of a turbine blade according to an embodiment of the present disclosure.
Figure 4:
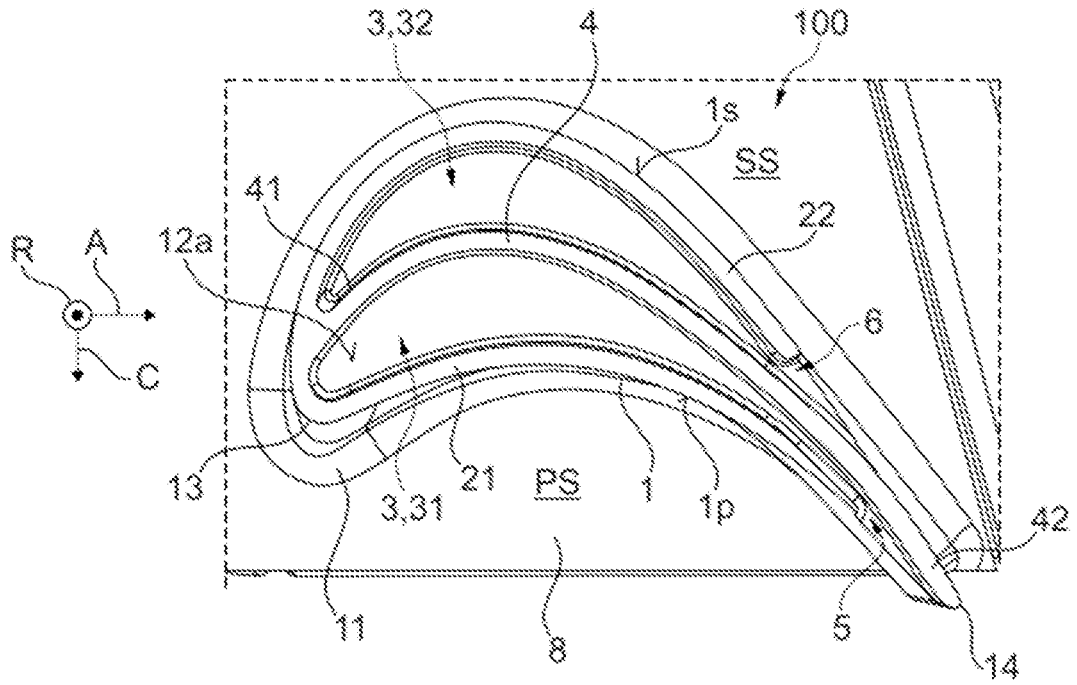
FIG. 4 shows a top view of a turbine blade according to an embodiment of the present disclosure.
Figure 5:
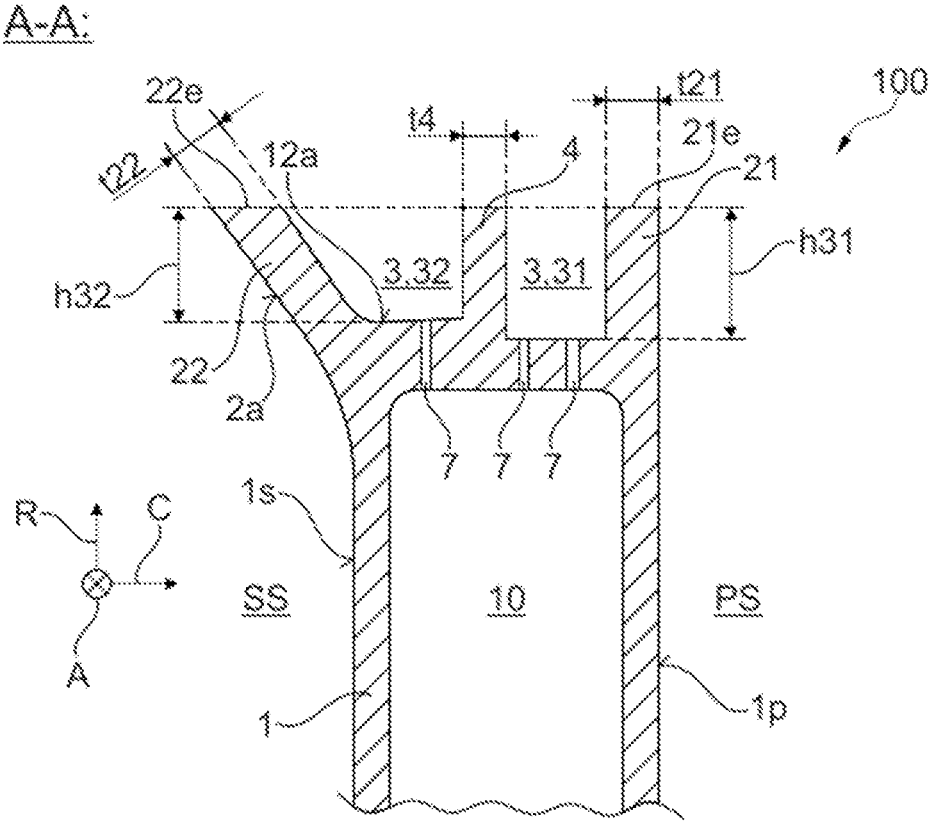
FIG. 5 shows a schematic cross-sectional view of the blade of FIG. 3 taken along line A-A in FIG. 3.
Figure 6:
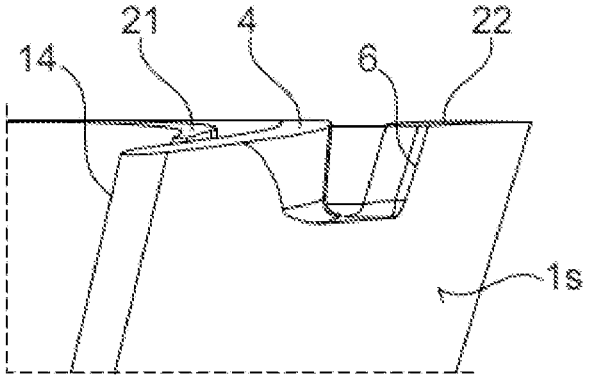
FIG. 6 schematically illustrates a detailed view of a second exit opening of a turbine blade according to an embodiment of the present disclosure.

Referring to FIGS. 3 to 4, the blade 100 further comprises squealer tip wall 2, a separator wall 4, a first exit opening 5, and a second exit opening 6. As shown in FIG. 5, the blade 100 may further include an inner cavity or void 10.

As visible best in FIGS. 3 and 4, the tip 12 of the airfoil 1 has a tip surface 12*a*. The tip surface 12*a* extends transverse to the radial direction R and forms a part of a radially outer surface of the airfoil 1. As shown in FIGS. 4 and 5, the tip surface 12*a* may be planar or substantially planar in the axial direction A and the circumferential direction C. However, the tip surface 12*a* may also be curved, e.g. with a concave or convex curvature.

The squealer tip wall 2 protrudes from the tip surface 12*a* in the radial direction R. Generally, the squealer tip wall 2 may extend along at least a part of the periphery of the radially outer end of the airfoil 1. For example, the squealer tip wall 2 may extend substantially along the entire periphery of the radially outer end of the airfoil 1, as exemplarily shown in FIGS. 3 and 4. The squealer tip wall 2 may comprise a first wall portion 21 that extends in a first peripheral area of the tip surface 12*a* facing the pressure side PS, and a second wall portion 22 of the squealer tip wall 2 that extends in a second peripheral area of the tip surface 12*a* facing the suction side SS. As shown in FIGS. 3 and 4, as the squealer tip wall 2 extends along at least a part of the periphery of the radially outer end of the airfoil 1, it defines or limits a tip cavity 3. The tip cavity 3 is surrounded by the squealer tip wall 2. The tip surface 12*a* forms a bottom of the tip cavity 3.

An outer lateral surface 2*a* of the squealer tip wall 2 may form a continuous surface with the pressure side surface 1*p* and suction side surface 1*s*, respectively. As visible in FIG. 3, the squealer tip wall 2 protrudes, at least partially, in the radial direction from the tip surface 12*a*. As shown in FIG. 5, it may be provided that at least a section of the squealer tip wall 2 protrudes over at least one of the suction side surface 1*s* and a pressure side surface 1*p*, in particular, with respect to the circumferential direction C to form a winglet structure. In particular, it may be provided that the squealer tip wall 2 protrudes over at least one of the suction side surface 1*s* to form the winglet structure, as exemplarily shown in FIG. 5. In other words, the squealer tip wall 2 may be formed by protruding from the periphery of the tip surface 12*a* facing the suction side surface 1*s* in the radial direction while being inclined toward the circumferential direction C.

As further shown in FIGS. 3 to 5, the separator wall 4 protrudes in the radial direction R from the tip surface 12*a* and extends, at least partially, along the axial direction A. For example, as shown in FIGS. 3 and 4, the separator wall 4 may extends curved in an arc shape. Generally, the separator wall 4 may extend from the region of the leading edge 13 to the region of the trailing edge 14. For example, the separator wall 4, with a first end portion 41, may be connected to the squealer tip wall 2. As exemplarily shown in FIGS. 3 and 4, the separator wall 4, for example, may be connected to the second wall portion 22 of the squealer tip wall 2. As further exemplarily shown in FIG. 3, the separator wall 4 may extend to an end at the trailing edge 14. Generally, a second end portion 42 of the separator wall 4 is positioned in the region of the trailing edge 14.

As visible in FIGS. 3 to 4, the separator wall 4 divides the tip cavity 3 into a first tip cavity 31 and a second tip cavity 32. The first tip cavity 31 lies on a first side of the separator wall 4 facing the pressure side PS. The first tip cavity 31, therefore, is limited and surrounded by the separator wall 4 and the first wall portion 21. The second tip cavity 32 lies on a second side of the separator wall 4 facing the suction side SS. The second tip cavity 32, therefore, is limited and surrounded by the separator wall 4 and the second tip wall portion 22. According to an embodiment, the separator wall 4 may continuously extend from its upstream end to the downstream end without a disconnecting region therebetween such that the first tip cavity 31 and the second tip cavity 32 are separated by the separator wall 4. As shown in FIG. 3, a plurality of cooling holes 7 may be formed in the tip surface 12*a* within the first tip cavity 31, i.e., in the part of the tip surface 12*a* lying between the first wall portion 21 and the separator wall 4. Though not visible in FIG. 3, cooling holes 7 may also be formed in the tip surface 12*a* within the second tip cavity 32, i.e., in the part of the tip surface 12*a* lying between the second wall portion 22 and the separator wall 4. As schematically shown in FIG. 5, the cooling holes 7 may be connected to the inner cavity or void 10 of the blade 100 so that cooling fluid such as a cooling air may be discharged through the cooling holes 7 on the tip surface 12*a*.

As further visible in FIGS. 3 and 4, the first wall portion 21 and the separator wall 4 may approach each other towards the trailing edge 14. That is, a width of the first tip cavity 31 in the circumferential direction C between the first wall portion 21 and the separator wall 4 may decrease towards the trailing edge 14. Similar, the second wall portion 22 and the separator wall 4 may approach each other towards the trailing edge 14 at least in an end region of the second wall portion 22. That is, a width of the second tip cavity 32 in the circumferential direction C between the second wall portion 22 and the separator wall 4 may decrease towards the trailing edge 14, at least in an end region of the second wall portion 22.

The squealer tip wall 2 and separator wall 4 according to the present disclosure helps in preventing the over tip leakage flow, that is, a flow of working fluid from the pressure side PS to the suction side SS over the tip of the airfoil 1.

According to an embodiment, the first and second exit openings 5, 6 may be each formed in the squealer tip wall 2 in the area of the trailing edge 14. The first exit opening 5 defines a fluid passage between the first tip cavity 31 and the pressure side PS. As shown in FIGS. 3 and 4, the first exit opening 5 is formed in the first wall portion 21. The second exit opening 6 defines a fluid passage between the second tip cavity 32 and the suction side SS. As shown in FIGS. 3 and 4, the second exit opening 6 is formed in the second wall portion 22.

Generally, the exit openings 5, 6 are formed in the squealer tip wall 2. That is, portions of the squealer tip wall 2 are removed to form the respective opening 5, 6. As exemplarily shown in FIGS. 3 and 4, the first and second wall portions 21, 22 may be formed to terminate at a distance from the trailing edge 14 while the separator wall 4 extends to the trailing edge 14, creating a gap between the separator wall 4 and the end region of the respective wall portions 21, 22 that defines the respective opening 5, 6.

As mentioned before, the first wall portion 21 of the squealer tip wall 2 and the separator wall 4 may approach each other towards the trailing edge 14. A channel may be defined between the downstream end region of the first wall portion 21 and the separator wall 4. Further, it may be provided that the separator wall 4 extends further towards the trailing edge 14 than the first wall portion 21 of the squealer tip wall 2, as shown in FIGS. 3 and 4. In other words, the downstream end of the separator wall 4 reaches the trailing edge 14. In this case, the first exit opening 5 is formed at the downstream end of the channel, wherein the downstream end of the channel is defined by an end of the first wall portion 21 of the squealer tip wall 2. As exemplarily shown in FIG. 3, an optional groove 16 may be formed in a transition between the tip surface 12*a* and the pressure side surface 1*p* adjacent to the trailing edge 14. That is, the groove 16 may be in a chamfered shape. The groove 16 may be formed as a concave surface and extend between the trailing edge 14 and the downstream end of the first wall portion 21 of the squealer tip wall 2. As shown in FIG. 3, the first exit opening 5 may open into or toward the groove 16. Further optionally, cooling holes 7 may be formed within the groove 16. Thus, cooling air can be discharged from the inner cavity 10 also in a region very close to the trailing edge 14 through the cooling holes 7 formed in the groove 16. As shown in FIG. 4, it is possible that the groove 16 is omitted. As further visible in FIGS. 3 and 4, a wall thickness of the first wall portion 21 of the squealer tip wall 2, in the downstream end region of the first wall portion 21, may decrease toward and to the end facing the trailing edge 14. Thereby, a channel of substantially constant width may be formed between the separator wall 4 and the end region of the first wall portion 21. In other words, at least a portion of the channel between the separator wall 4 and the downstream end region of the first wall portion 21 may have a constant width.

The second exit opening 6 may also be formed at the downstream end of a channel defined between the separator wall 4 and a downstream end portion of the second wall portion 22 facing the trailing edge 14. As shown in FIGS. 3 and 4, the separator wall 4 may extend further towards the trailing edge 14 than the second wall portion 22 of the squealer tip wall 2, and the downstream end of the second wall portion 22 defines the downstream end of the channel. In FIG. 3, it is exemplarily shown that a wall thickness of the second wall portion 22 of the squealer tip wall 2, in the downstream end region of the second wall portion 22, may decrease toward and to the end facing the trailing edge 14. For example, the downstream end region of the second wall portion 22 may form a wedge as exemplarily shown in FIG. 3. Thereby, a channel of substantially constant width may be formed between the separator wall 4 and the end region of the second wall portion 22. In other words, at least a portion of the channel between the separator wall 4 and the downstream end region of the second wall portion 22 may have a constant width. However, it may also be provided that the second wall portion 22 has a substantially constant wall thickness and only ends with a distance the trailing edge 14 as exemplarily shown in FIGS. 4 and 6. As further shown in FIGS. 4 and 6, in this case, in the downstream end of the second wall portion 22 facing the trailing edge 14, a convex radius may be formed on an inner edge of the end of second wall portion 22. In other words, the downstream end of the second wall portion 22 may be in a convex shape protruding toward trailing edge 14.

According to the present disclosure, the first and second exit openings 5, 6 allow discharging fluid leaked from the pressure side PS or the suction side SS into the respective first and second tip cavity 31, 32. Thereby, the leaked fluid can be efficiently conducted back into the main flow of working fluid flowing along the pressure side surface 1*p* and the suction side surface 1*s*. Consequently, over tip leakage as such and potential secondary effects caused by the over tip leakage, such as formation of vortices, are reduced. Since the exit openings 5, 6 are formed in the squealer tip side wall 2, the leaked flow is smoothly guided within the cavities 31, 32 and discharged from the cavities 31, 32.

A distance L5 between the downstream end of the first exit opening 5 and the trailing edge 14 and/or a distance L6 between the downstream end of the second exit opening 6 and the trailing edge 14 may lie in a range between 1/12 to 1/3, in particular between 1/9 and 1/4 of a tip chord length tc1 of the airfoil 1 at the tip 12 when they are measured in a same direction. The tip chord length tc1 is measured at the tip 12 of the airfoil 1 in a direction which is parallel to a tangent line tL touching the airfoil 1 from the pressure side, as schematically shown in FIG. 3. The tip chord length tc1 may be defined as a distance between the trailing edge 14 and a point S1 on the suction side surface 1*s* having a greatest distance to the trailing edge 14. The tip chord length tc1 may lie in a range between 25 mm and 250 mm, for example. The distance of the first exit opening 5 and/or the second exit opening 6 to the trailing edge 14 may be measured parallel to the tangent line tL. Generally, the second exit opening 6 may be positioned further distanced to the trailing edge 14 than the first exit opening 5. Hence, distance L5 may be smaller than distance L6.

Figure 7:
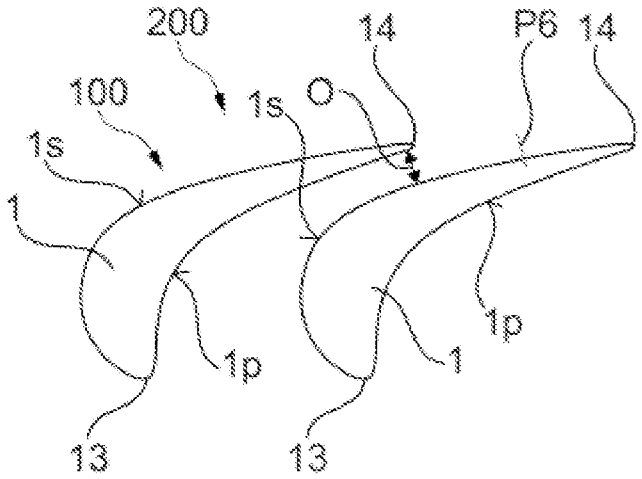
FIG. 7 schematically shows a partial cross-sectional view of a rotor assembly according to an embodiment of the present disclosure.

When assembled in the rotor assembly 200, and when a throat O is defined between the suction side surface 1*s* of a respective blade 100 and a pressure side surface 1*p* of an adjacent blade 100 positioned next to the respective blade 100, the second exit opening 6 of the respective blade 100 is positioned closer to the trailing edge 14 of the respective blade 100 than the throat O. More specifically, the upstream end of the second exit opening 6 of the respective blade 100 may be positioned closer to the trailing edge 14 of the respective blade than the throat O. This situation is schematically shown in FIG. 7 where two adjacent blades 100 are shown in a top view. It should be noted that no details of the tip 12 are shown in FIG. 7. As depicted in FIG. 7, the throat O is defined as a position on the suction side surface 1*s* of the airfoil 1 of the respective blade 100 with the shortest distance to the pressure side surface 1*p* of the adjacent blade 100. In FIG. 7, the position of the second exit opening 6, more specifically, the upstream end of the second exit opening 6, is only schematically indicated by the line P6. As visible, the second exit opening 6 may be positioned downstream of the throat O with respect to direction of flow from the leading edge 13 towards the trailing edge 14.

Referring to FIGS. 3 and 5, a wall thickness t4 of the separator wall 4 may lie in a range between 1/4 to 1/32 of a profile thickness Pt of the airfoil 1. Optionally, the wall thickness t4 may lie in a range between 1/16 to 1/32 of the profile thickness Pt. As schematically shown in FIG. 3, the profile thickness Pt may be defined as a diameter of an imaginary largest incircle IC touching the suction side surface 1*s* and the pressure side surface 1*p* of the blade 100 in the top view of the blade 100 where the diameter of the incircle IC is maximum. The profile thickness Pt is measured at the tip of the airfoil 1. The profile thickness may lie in a range between 11 mm and 65 mm, for example. The wall thickness t4 of the separator wall 4 may, for example, be in a range between 1.5 mm and 6.5 mm.

The wall thickness of the squealer tip wall 2 may lie substantially in the same range as the wall thickness t4 of the separator wall 4. For example, the wall thickness t21 of the first wall portion 21 and the wall thickness t22 of the second wall portion 22 each may lie in a range between 1/4 to 1/16 of the profile thickness Pt of the airfoil 1, e.g., in a range between 1.5 mm and 6.5 mm.

The first cavity 31 may comprise a first depth h31 measured in the radial direction R from the tip surface 12*a* in the first tip cavity 31 to a radial end 21*e* of the first wall portion 21. Likewise, the second tip cavity 32 may comprise a second depth h2 measured in the radial direction R from the tip surface 12*a* in the second tip cavity 32 to a radial end 22*e* of the second wall portion 22. Generally, the first depth h31 and the second depth h32 may lie in a range between 1.5 mm to 5.5 mm. Optionally, as exemplarily shown in FIG. 5, it may be provided that the second depth h32 is smaller than the first depth h31. The present disclosure, however, is not limited thereto and, generally, the first and the second depth h31, h32 may be different. Further, it may be provided that the first depth h31 and/or the second depth h32 vary along the axial direction.

The blade 100 may be manufactured, generally, in a casting process, such as conventional casting (CC), a directionally solidified (DS), or single crystal (SX) cast process. Nickel or Cobalt based high temperature alloys may be used for casting the blade 100.

The separator wall 4 may be formed by conventional manufacturing methods, e.g., by casting or machining. Alternatively, the separator wall 4 may be additively manufactured or may be formed by any combination of additive and subtractive methods. Nickel or Cobalt based high temperature alloys suitable for additive manufacturing may be used to form the separator wall 4 in an additive manufacturing process.

The surfaces on the tip 12 of the airfoil 1, i.e., the tip surface 12*a*, the surfaces of the squealer tip wall 2 and the surfaces of the separator wall 4 may be coated. For example, MCrAlY material or other suitable coating material may be used as bondcoat and applied, for example, by a low pressure plasma spray (LPPS), a vacuum plasma spray (VPS), or a high velocity oxy fuel (HVOF) process. Further optional, a topcoat may be applied. For example, a single or multi-layered ceramic, e.g., YSZ, may be applied by LPPS, an air plasma spray (APS), or similar.

Although only examples comprising one single separator wall 4 have been discussed above, the present disclosure is not limited thereto. Rather, two or more separator may be provided, e.g., to further divide the first or second tip cavity 31, 32 into sub cavities.

Although specific embodiments have been illustrated and described herein, it will be appreciated by those of at least ordinary skill in the art that a variety of alternate and/or equivalent implementations exist. It should be appreciated that the exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims. Generally, this application is intended to cover any adaptations or variations of the specific embodiments discussed herein. Also, it is noted that any one feature of an embodiment of the present disclosure described in the specification may be applied to another embodiment of the present disclosure.

LIST OF REFERENCE SIGNS

1 airfoil
1*p* pressure side surface
1*s* suction side surface
2 squealer tip wall
2*a* outer lateral surface of squealer tip wall
3 tip cavity
4 separator wall
5 first exit opening
6 second exit opening
7 cooling holes
8 platform
9 root
10 inner cavity
13 leading edge
14 trailing edge
16 groove
21 first wall portion of squealer tip wall
21*e* end of first wall portion
22 second wall portion of squealer tip wall
22*e* end of second wall portion
31 first tip cavity
32 second tip cavity
41 first end portion of separator wall
42 second end portion of separator wall
100 blade
200 rotor assembly
210 rotor disk
219 coupling interface
300 gas turbine
310 compressor
312 compressor blade
313 compressor vane
320 burner
330 turbine
335 turbine vane
336 turbine blade
350 rotor
A axial direction
A350 rotational axis
C circumferential direction
h31 first depth
h32 second depth
IC incircle
L width of the support surface
L5 distance of the first exit opening to the trailing edge
L6 distance of the second exit opening to the trailing edge
O throat
P6 dotted line
PS pressure side
Pt profile thickness
R radial direction
SS suction side
t4 wall thickness of separator wall
t21 wall thickness of first wall portion
t22 wall thickness of second wall portion
tc1 tip chord length
tL tangent line

The invention claimed is:

1. A blade for a turbine, comprising:

an airfoil extending between a platform end and a tip and in a radial direction and extending between a leading edge and a trailing edge in an axial direction, wherein the tip comprises a tip surface, and wherein a pressure side surface and a suction side surface meet at the leading edge and at the trailing edge, the pressure side surface defining a pressure side of the airfoil, and the suction side surface defining a suction side of the airfoil;

a squealer tip wall protruding from the tip surface and defining a tip cavity;

a separator wall protruding in the radial direction from the tip surface and dividing the tip cavity into at least a first tip cavity lying on a first side of the separator wall facing the pressure side, and a second tip cavity lying on a second side of the separator wall facing the suction side;

a first exit opening formed in the squealer tip wall in the area of the trailing edge, the first exit opening defining a fluid passage between the first tip cavity and the pressure side; and a second exit opening formed in the squealer tip wall in the area of the trailing edge, the second exit opening defining a fluid passage between the second tip cavity and the suction side, wherein the squealer tip wall comprises a first wall portion that extends in a first peripheral area of the tip surface facing the pressure side, and a second wall portion of the squealer tip wall that extends in a second peripheral area of the tip surface facing the suction side, wherein the separator wall is connected to the second wall portion of the squealer tip wall at an upstream end, extends to a downstream end and remains distanced both to the first wall portion and the second wall portion while extending to the downstream end.

2. The blade of claim 1, wherein the separator wall extends from a region of the leading edge to the trailing edge of the airfoil.

3. The blade of claim 1, wherein the separator wall extends curved in an arc shape.

4. The blade of claim 1, wherein a wall thickness of the separator wall lies in a range between ¼ to 1/32 of a profile thickness of the airfoil.

5. The blade of claim 1, wherein the first exit opening is formed in the first side wall portion, and wherein the second exit opening is formed in the second side wall portion.

6. The blade of claim 5, wherein the separator wall extends to the trailing edge of the airfoil.

7. The blade of claim 5, wherein the first wall portion of the squealer tip wall ends distanced to the trailing edge, and the first exit opening is formed as a gap between a downstream end region of the first wall portion facing the trailing edge and a downstream end region of the separator wall facing the trailing edge.

8. The blade of claim 7, wherein a groove is formed in a transition between the tip surface and the pressure side surface adjacent to the trailing edge, and wherein the first exit opening opens into the groove.

9. The blade of claim 5, wherein the second wall portion of the squealer tip wall ends distanced to the trailing edge, and the second exit opening is formed as a gap between an end region of the second wall portion facing the trailing edge and an end region of the separator wall facing the trailing edge.

10. The blade of claim 1, wherein the airfoil, at the tip, comprises a tip chord length, and a distance of the first exit opening to the trailing edge and/or a distance of the second exit opening to the trailing edge lies in a range between 1/12 to ⅓, in particular between ⅙ and ¼ of the tip chord length.

11. The blade of claim 1, wherein the first tip cavity comprises a first depth measured in the radial direction from the tip surface in the first tip cavity to a radial end of the first wall portion, and wherein the second tip cavity comprises a second depth measured in the radial direction from the tip surface in the second tip cavity to a radial end of the second wall portion, the second depth being different from the first depth.

12. The blade of claim 1, wherein a plurality of cooling holes are formed in the tip surface in the first tip cavity and/or in the second tip cavity.

13. A rotor assembly for a turbine, comprising:

a rotor disk; and a plurality of the blades of claim 1 coupled to the rotor disk.

14. The rotor assembly of claim 13, wherein the second exit opening is positioned closer to the trailing edge of the respective blade than a throat defined between the suction side surface of the respective blade and a pressure side surface of a further blade positioned adjacent to the respective blade.

15. The rotor assembly of claim 13, wherein the separator wall extends from the region of the leading edge to the trailing edge of the airfoil.

16. The rotor assembly of claim 13, wherein the separator wall extends curved in an arc shape.

17. The rotor assembly of claim 13, wherein the first exit opening is formed in the first side wall portion, and wherein the second exit opening is formed in the second side wall portion.

18. The rotor assembly of claim 13, wherein the separator wall extends to the trailing edge of the airfoil.

19. The rotor assembly of claim 13, the first exit opening is formed as a gap between an end region of the first wall portion facing the trailing edge and an end region of the separator wall facing the trailing edge.

20. A turbine comprising a blade according to claim 1.

* * * * *